US011313150B1

(12) United States Patent
Ribacoff

(10) Patent No.: US 11,313,150 B1
(45) Date of Patent: Apr. 26, 2022

(54) MAGNETIC LOCK RELEASE INDICATOR / POWER FAILURE INDICATOR

(71) Applicant: Elie Ribacoff, Fresh Meadows, NY (US)

(72) Inventor: Elie Ribacoff, Fresh Meadows, NY (US)

( * ) Notice: Subject to any disclaimer, the term of this patent is extended or adjusted under 35 U.S.C. 154(b) by 0 days.

(21) Appl. No.: 16/669,032

(22) Filed: Oct. 30, 2019

(51) Int. Cl.
*E05B 17/22* (2006.01)
*E05B 47/00* (2006.01)
*G08B 7/06* (2006.01)

(52) U.S. Cl.
CPC ..... *E05B 17/22* (2013.01); *E05B 47/0001* (2013.01); *G08B 7/06* (2013.01); *E05B 2047/0048* (2013.01); *E05B 2047/0057* (2013.01); *E05B 2047/0091* (2013.01); *E05B 2047/0097* (2013.01)

(58) Field of Classification Search
CPC ..... E05B 17/22; E05B 47/0001; E05B 2047/0048; E05B 2047/0057; E05B 2047/0091; E05B 2047/0097; G08B 7/06
See application file for complete search history.

(56) References Cited

U.S. PATENT DOCUMENTS 4,206,367 A * 6/1980 Petruska ..... H02M 7/217 307/12
5,337,588 A 8/1994 Chhatwal
5,374,923 A * 12/1994 Sakamoto ..... G01R 19/155 340/654
6,411,215 B1 * 6/2002 Shnier ..... E05B 17/22 250/221
8,674,823 B1 * 3/2014 Contario ..... H02J 1/10 340/333
10,036,182 B2 7/2018 Yoshikawa et al.
2003/0174210 A1 * 9/2003 Vimpari ..... G08B 13/19658 348/152
2007/0098281 A1 * 5/2007 Fujie ..... G11B 33/128 382/239
2009/0173119 A1 7/2009 Hunt et al.
2009/0232480 A1 * 9/2009 Jendbro ..... H04N 5/772 386/224
2013/0038445 A1 * 2/2013 Tatara ..... B60L 11/1816 340/463
2013/0098712 A1 4/2013 Svendsen et al.
2014/0076072 A1 * 3/2014 Gore ..... G08B 29/046 73/865.8
2015/0115622 A1 * 4/2015 Burdenko ..... E05B 47/0003 292/138
2015/0167350 A1 * 6/2015 Bryla ..... E05B 47/00 292/138
2016/0169578 A1 * 6/2016 Linney, II ..... F25D 11/04 62/56
2018/0108192 A1 * 4/2018 Ho ..... G06Q 10/08

* cited by examiner

*Primary Examiner* — Chico A Foxx
(74) *Attorney, Agent, or Firm* — Volta Law Group

(57) ABSTRACT

An electrical lock monitoring device which can be retrofitted onto an existing electrical lock control system. The device can be powered by the existing power mains for the electrical lock control system. In the event of a power failure, an indicator is activated to advise users of a power failure. The device can be electrically connected to trigger an alarm, camera, siren, or other devices. Once the power has been restored, the device is automatically reset.

7 Claims, 1 Drawing Sheet

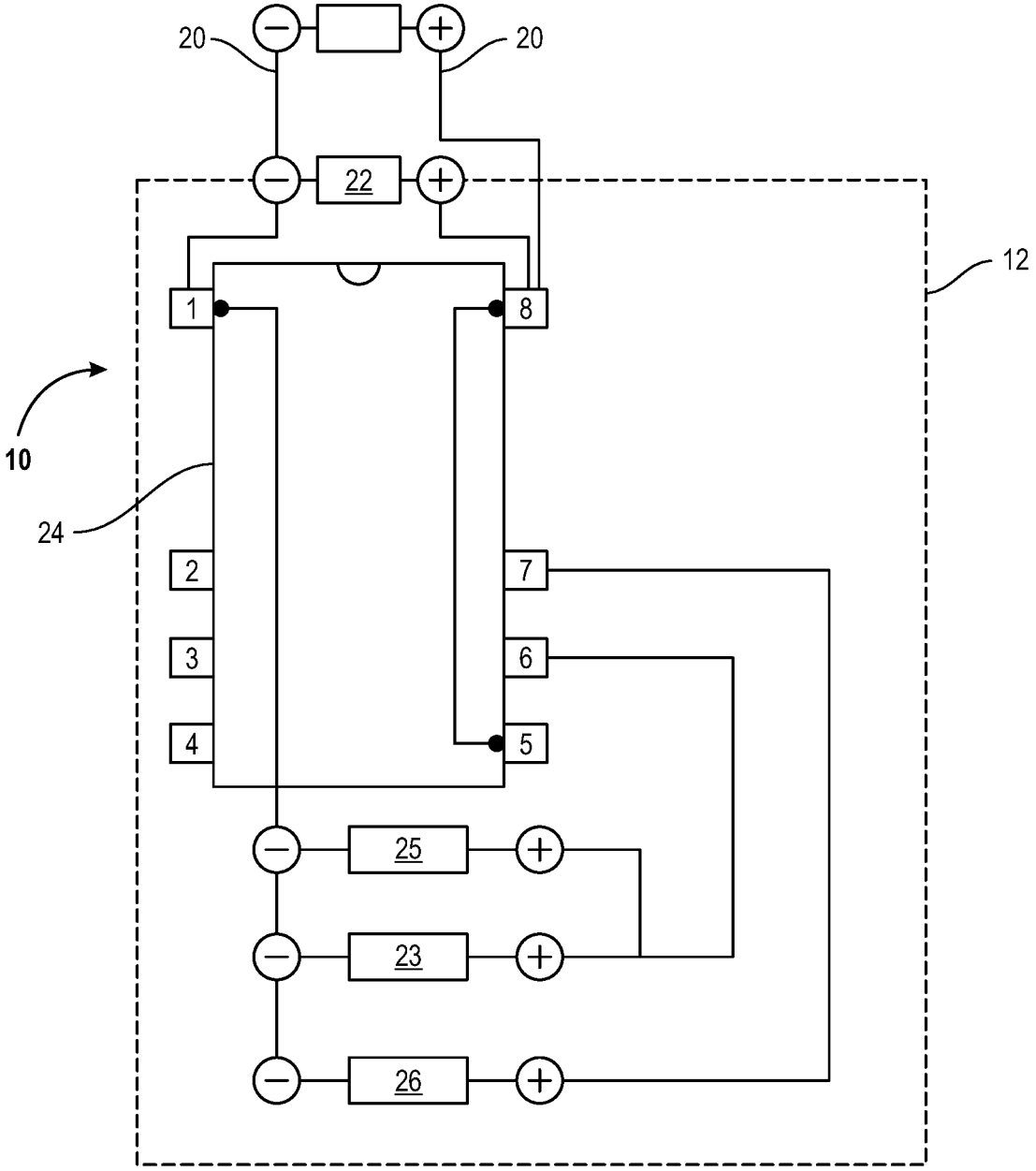
20
20
22
12
1
8
10
24
2
7
3
6
4
5
25
23
26

MAGNETIC LOCK RELEASE INDICATOR / POWER FAILURE INDICATOR

BACKGROUND OF THE INVENTION

1. Field of the Invention

The present invention relates to electrically powered lock systems. More particularly, the present invention relates to a power monitoring/power failure indicating device for electromagnetic locking systems.

2. Description of the Prior Art

Electromagnetic locking systems are well known in the art. Typically, these systems use electromagnets to position a deadbolt or other type of latching member in a locked position. Often, these systems power and control many locks within a single structure. Accordingly, control circuits for these system tend to be complex, and typically require a separately wired microprocessor. A problem with these systems is that in the event of a power failure the lock becomes inoperable and unlocked. While the microprocessor based systems are effective, they tend to be complex and costly, and require extra wiring to provide electrical power.

Typical of these is the system described in U.S. Pat. No. 8,687,341 which relates to a system for controlling electrically powered locking systems. As with most of these systems, circuitry is added to the system, which circuitry is "external" to the system and requires extra wiring.

The present invention is directed to an electrical lock monitoring device which can be retrofitted onto an existing electrical lock control system. The device can be powered by the existing power mains for the electrical lock control system. In the event of a power failure, an indicator is activated to advise users of a power failure. The device can be electrically connected to trigger an alarm, camera, siren, or other devices. Once the power has been restored, the device is automatically reset.

SUMMARY OF THE INVENTION

It is a major object of the invention to provide a device for monitoring power failure in an electrically operated locking system.

It is another object of the invention to provide a device for indicating power failure in an electrically operated locking system.

It is another object of the invention to provide a device for monitoring power failure in an electrically operated locking system and activating signaling devices in response to a power failure.

It is another object of the invention to provide a device for indicating power failure in an electrically operated locking system which uses an electro-mechanical switch.

It is another object of the invention to provide a device for monitoring power failure in an electrically operated locking system and activating a siren in response to a power failure.

It is another object of the invention to provide a device for monitoring power failure in an electrically operated locking system and activating a camera in response to a power failure.

BRIEF DESCRIPTION OF THE DRAWINGS

Various other objects, features, and attendant advantages of the present invention will become more fully appreciated as the same becomes better understood when considered with the accompanying drawings, in which like reference characters designate the same or similar parts throughout the several views, and wherein:

FIG. 1 shows a circuit diagram for the device of the invention.

DETAILED DESCRIPTION OF THE PREFERRED EMBODIMENTS

The inventive device, depicted in FIG. 1 and generally designated by the numeral 10, is intended to be used with an electrically activated locking system. A representative circuitry for enabling the present invention is presented including components, devices and their interconnections.

The present invention generally relates to a system and method for providing power failure indicator for an electric unlocking device such as an electric door strike. The present invention provides circuitry which can be easily retrofitted to an existing electric locking system. The present invention is applicable to doors, gates or other similar access mediums that may be locked/unlocked remotely or locally by the use of a supplied power source and an electric unlocking device.

Referring now to FIG. 1, the device 10 is shown in circuit diagram form. Preferably, the device 10 is contained within a housing 12 so that it is portable and can be reused. The device 10 is connected in parallel with the power supply lines 20 of the electric locking system (not shown). Terminals of the device 10 are connected across supply lines 20 using any known means for making an electrical contact. The device 10 as connected will provide power to an indicating LED 22, an audible transducer 23 such as a buzzer, or any other electrically operable indicating device in the event of a power failure. The device 10 may also be used to activate an LED or other indicating device 25 which may be capable of sending telemetry to a remote operator, using any well known means for sending telemetry. Optionally, indicating device 25 may be a video camera which can capture and send images via telemetry or other means to a remote operator.

The device 10 uses a double pole double throw (DPDT) relay 24 as the primary power "sensing" and device activating element. As can be seen, an LED 22 is connected across terminals 1 and 8, these being the terminals of the activating coil as is known. Terminal 8 is connected to pole 2 the normally open contact. When power fails, the LED 22 is deactivated as the normally open circuit is open, the LED 22 being powered by the power mains 20 for the locking system. In lieu of capacitor 26, a rechargeable battery may be used to power the device 10 in a power outage scenario. Buzzer 23 is connected between terminals 1 and 7 and is also activated to produce an audible indication when the power fails.

A key aspect of the invention is the ability of the device 10 to be retrofit onto an existing electrical locking system. Prior art methods require either a complete overhaul of the existing system to include power outage monitoring capability, or use a separately powered monitoring system, which system requires a source of power and typically, substantial physical modifications on site. With the present method, the device 10 is wired into the locking system, with at least one device 10 for each separate circuit supplying electricity to the locking system, so that even a partial power outage is detected.

In use, the device 10 is connected in parallel with the power supply for the electric locking system (one for each separate circuit as stated above), which connection activates the device 10 and charges the capacitor 26. In the event of a power outage, the device 10 will energize buzzer 23 and LED 25, or any other device (25) for as long as it takes capacitor 26 to discharge, which is a function of the capacitance of the device 26. When power is restored, the device 10 essentially resets and is ready to give another indication of power failure once capacitor 26 is fully recharged.

I claim:

1. A device for monitoring power in an electrically activated lock system, said system having a source of electrical power, the device comprising:

an electro-mechanical switch for sensing said power, said electro-mechanical switch connected to said source of electrical power;

at least a visible and an audible transducer connected to said electro-mechanical switch;

a power storing component connected to said source of electrical power via said electro-mechanical switch, said power storing element receiving power continuously when said source of electrical power is on and discharging when said power is off;

wherein said electro-mechanical switch is a double pole double throw relay; and whereby said visible and audible transducer are activated by said discharging power storage element when said source of electrical power is off.

2. The device of claim 1 wherein said device is contained within a single housing.

3. The device of claim 1 wherein said device can be retrofitted into an existing electrically activated locking system.

4. The device of claim 1 including a video camera, said video camera activated when said source of electrical power is off.

5. The device of claim 1 wherein a video camera can capture and transmit images to a remote operator.

6. The device of claim 1 wherein said power storage element is capacitor.

7. A method for retrofitting an electric locking system for power monitoring; said electric locking system having a source of electrical power, the method comprising the steps of:

connecting an electro-mechanical switch to said locking system for sensing said power, said electro-mechanical switch connected to said source of electrical power;

connecting at least a visible and an audible transducer to said electro-mechanical switch;

connecting a power storing element to said source of electrical power;

whereby said power storage element provides power to said visible and audible transducers when said power is off.

* * * * *